US006351198B1

(12) United States Patent
Tsukamoto et al.

(10) Patent No.: US 6,351,198 B1
(45) Date of Patent: Feb. 26, 2002

(54) DIELECTRIC FILTER, DUPLEXER, AND COMMUNICATION APPARATUS

(75) Inventors: Hideki Tsukamoto, Ishikawa-ken; Katsuhito Kuroda, Matsuto; Jinsei Ishihara, Kanazawa; Hideyuki Kato, Ishikawa-ken, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/440,865

(22) Filed: Nov. 16, 1999

(30) Foreign Application Priority Data

Nov. 25, 1998 (JP) ..... 10-334360

(51) Int. Cl.[7] ..... H01P 1/20; H01P 5/12
(52) U.S. Cl. ..... 333/206; 333/202; 333/134
(58) Field of Search ..... 333/202, 206, 333/134, 207

(56) References Cited

U.S. PATENT DOCUMENTS 4,806,889 A * 2/1989 Nakano et al. ..... 333/202
5,905,420 A * 5/1999 Tsujiguchi et al. ..... 333/206
6,057,745 A * 5/2000 Sonoda et al. ..... 333/134

FOREIGN PATENT DOCUMENTS

EP 0831544 A1 * 3/1998

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

The open faces of resonator holes of a dielectric filter are capable of being formed with high dimensional precision by a simple process, by which a coupling between resonators and an external coupling can easily be adjusted. In addition, a duplexer including the dielectric filter, and a communication apparatus including at least one of the dielectric filter and the duplexer are provided. The dielectric filter includes a dielectric block having protrusions on the upper surface of a substantially rectangular-parallelepiped base. Resonator holes are disposed by penetrating from the end faces of the protrusions to the lower surface of the base that opposes the end faces. External coupling holes are disposed by penetrating the opposing upper and lower surfaces of the base. An inner conductor is formed on the inner surface of each hole, and an outer conductor is formed on the substantially entire outer surface of the dielectric block except the end faces of the protrusions. Additionally, input and output electrodes separated from the outer conductor are formed at the openings of the external coupling holes on the lower surface of the dielectric block.

7 Claims, 3 Drawing Sheets

DIELECTRIC FILTER, DUPLEXER, AND COMMUNICATION APPARATUS

BACKGROUND OF THE INVENTION

1. Field of the Invention

The present invention relates to a dielectric filter, a duplexer used in a microwave band or the like, and a communication apparatus including the same.

2. Description of the Related Art

FIG. 6 shows an example of a prior art dielectric filter used in a microwave band. In the figure, shaded parts are non-conducting portions where the base material of a dielectric block is exposed.

In the dielectric filter, resonator holes 2*a* and 2*b*, and external coupling holes 3*a* and 3*b* are disposed to penetrate opposing end faces, which are the upper and lower surfaces shown in FIG. 6, of a dielectric block 1. An inner conductor is formed on each of the inner peripheral surfaces of those holes, and an outer conductor 6 is formed on the outer surfaces of the dielectric block 1. At the upper surface of the dielectric block 1, the non-conducting portions of the outer conductor 6 are disposed around the opening portions of the resonator holes 2*a* and 2*b* to separate the inner conductor of the resonator holes 2*a* and 2*b* from the outer conductor 6. Thus, the upper surface of the dielectric block 1 is used for the open face of each resonator hole. Meanwhile, at the lower surface of the dielectric block 1, the inner conductors of the resonator holes 2*a* and 2*b* are electrically connected, namely, short-circuited to the outer conductor 6, so that the lower surface of the dielectric block 1 is used for the short-circuited face of each of the resonator holes 2*a* and 2*b*. In addition, input and output electrodes 7*a* and 7*b* separated from the outer conductor 6 are formed extending over the lower and side surfaces of the dielectric block 1. The inner conductors of the external coupling holes 3*a* and 3*b* are electrically connected to the outer conductor 6 at the upper surface of the dielectric block 1, and are electrically connected to the input and output electrodes 7*a* and 7*b*, respectively, at the lower surface thereof.

In the dielectric filter, the individual resonators corresponding to the resonator holes 2*a* and 2*b* make a comb-line coupling by stray capacitance Cs occurring between the non-conducting portions of the outer conductor 6, and the external coupling holes 3*a* and 3*b* make an inter-digital coupling with the adjacent resonator holes 2*a* and 2*b*, respectively, so as to obtain an external coupling. The degree of coupling between the resonators is determined by adjusting the configuration and size of the non-conducting portion at the open face of each resonator hole to change the value of stray capacitance Cs.

In this way, when a conductor for obtaining a coupling between resonators is formed on the open face of each resonator hole, or when one end face of a resonator hole is an open face so that an external coupling is obtained by an inter-digital coupling between an external coupling hole and a resonator hole, it is necessary to dispose an area having the outer conductor formed and an area devoid of the outer conductor on the one end face of the dielectric block.

In this dielectric filter, the outer conductor on the open face is formed by cutting off specified parts of a pattern-printed conductor or a conductor formed by coating the entire open face.

In the prior art dielectric filter described above, however, since the open face, as the opening end of the resonator hole, is formed by pattern-printing or partially cutting off the outer conductor, there are problems in that the formation of the open face of a resonator hole is complicated and manufacturing procedures are increased so that manufacturing costs rise. Moreover, it is difficult to form the outer conductor of the open-face side in a desired configuration with high precision, which causes problems such as deterioration in filter characteristics and increase in characteristic variations. In other words, in the case of the printing method, deviations in printing patterns and spreading or unevenness of conductive pastes occur, while in the method of partially removing a conductor, removal with high dimensional precision is difficult, with the result that the outer conductor cannot be formed with high precision on the surface on the open-face side.

In addition, it is difficult to set and adjust stray capacitance for coupling between the resonators of the conventional dielectric filter, and a large capacitance cannot be obtained.

SUMMARY OF THE INVENTION

To overcome the above described problems, preferred embodiments of the present invention provide a dielectric filter, a duplexer, in which the open face of a resonator hole can easily be formed with a high dimensional precision and a coupling between resonators and an external coupling can easily be adjusted, and a communication apparatus incorporating the same.

One preferred embodiment of the present invention provides a dielectric filter having a dielectric block including a base having a pair of opposing end faces, a plurality of protrusions formed on one end face of the base, a resonator hole penetrating from an end face of each protrusion to the other end face of the base, at least one external coupling hole penetrating between both end faces of the base, an inner conductor formed on each of the inner surfaces of the resonator holes and the at least one external coupling hole, and an outer conductor formed on substantially the entire outer surface of the dielectric block except the end face of each protrusion as an open face of each resonator hole.

In the above described dielectric filter, the axial lengths of the resonator holes may be the same.

In addition, an input and output electrode connected to the inner conductor of the at least one external coupling hole and separated from the outer conductor may be formed extending over the other end face of the base of the dielectric block or both the other end face and a side surface thereof.

Another preferred embodiment of the present invention provides a duplexer including a dielectric block having at least two or more filters formed therein, in which at least one of the filters is the dielectric filter described above.

Yet another preferred embodiment of the present invention provides a communication apparatus including at least one of the dielectric filter and the duplexer described above.

In the dielectric filter or the duplexer having such structures, the resonator holes are formed by penetrating inside the plurality of protrusions formed on the base of the dielectric block, and the external coupling hole is formed by penetrating the base, by which the open face of each resonator hole is protruded in contrast to that of the external coupling hole. As a result, after formation of the conductors including the inner conductor and the outer conductor on the entire surface of the dielectric block, the open face of each resonator hole can easily be formed by grinding the end face of each protrusion to remove the outer conductor formed thereon. Moreover, since the shape of the open face of each resonator is determined by the configuration of the protrusion, that is, by the outside shape of the protrusion and the shape of the resonator hole, a high dimensional accuracy is obtainable.

In this case, the protrusion is formed in a tube shape, and in the proximity to the open face of the resonator hole, the outer conductor formed on the external periphery of the protrusion and the inner conductor of each resonator hole oppose along the length of the protrusion so that a high stray capacitance contributing to a coupling between the resonators can steadily be obtained. In addition, the stray capacitance can be adjusted over a wide range and the magnitude of an external coupling can be adjusted by changing the configuration of the protrusion.

In other words, in the arrangement of the present invention, the open face of the resonator hole can be formed in a short period of time with high precision, and a desired stray capacitance can steadily be obtained by an easy procedure. Accordingly, a coupling between the resonators and an external coupling can be adjusted with high precision over a wide range.

Furthermore, when the axial lengths of the resonators are made equal, the end faces of the protrusions as the open faces of the resonators can be all surface-ground at one time. As a result, the manufacturing procedure in forming the open faces can be simplified.

Furthermore, on the other end face opposing the end face on which the protrusions are disposed, the input and output electrode separated from the outer conductor is formed to make an inter-digital coupling between the external coupling hole and the adjacent resonator hole so as to obtain a larger external coupling.

Furthermore, since the communication apparatus in accordance with the present invention is formed by including a dielectric filter or a duplexer having the above described characteristics, production cost is reduced and satisfactory characteristics are obtainable.

DESCRIPTION OF THE PREFERRED EMBODIMENTS

Figure 1:
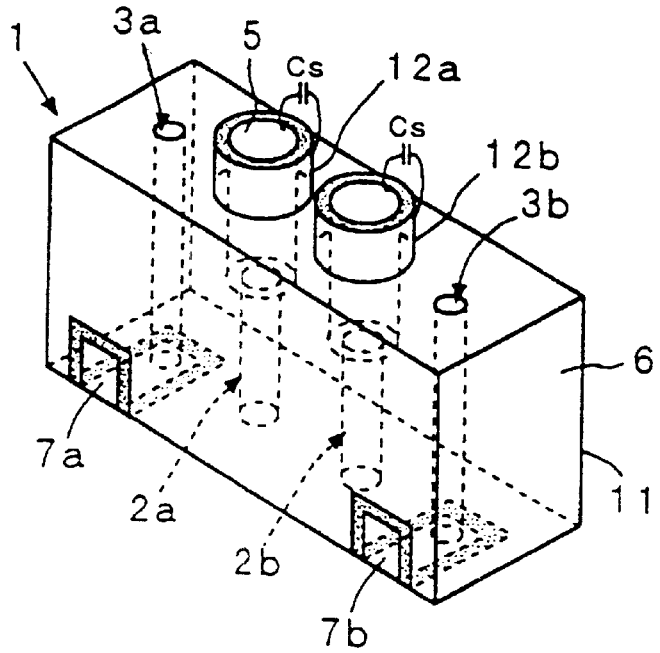
FIG. 1 is a perspective view of a dielectric filter according to a first embodiment of the present invention.

Referring to FIG. 1, a description will be given of a structure of a dielectric filter according to a first embodiment of the present invention. FIG. 1 is a perspective view of the dielectric filter, in which the open faces of resonator holes are placed at the upper side and the surface for mounting onto a circuit board is placed at the front side.

This dielectric filter has a dielectric block 1 in which a plurality of protrusions 12*a* and 12*b* are disposed on one end face of a rectangular-parallelepiped base 11 (the upper surface in FIG. 1). Resonator holes 2*a* and 2*b* are disposed by penetrating from the end faces of the protrusions 12*a* and 12*b* of the dielectric block 1 to the other end face of the body 11 opposing the end faces thereof (the lower surface in FIG. 1), and external coupling holes 3*a* and 3*b* are disposed by penetrating between the mutually-opposing end faces of the base 11. Each of the holes 2*a*, 2*b*, 3*a*, and 3*b* is disposed in such a manner that their axes are mutually in parallel. The diameter of each of the resonator holes 2*a* and 2*b* is made larger at the part on the protrusion side and are made smaller at the part on the side of the base 11 to form a stepped hole. The diameter of each of the external coupling holes 3*a* and 3*b* is the same along the entire length of the hole to form a straight hole. The protrusions 12*a* and 12*b* are formed in tube shapes, the heights of both protrusions being equal. In this case, the resonator holes 2*a* and 2*b* are positioned at the center of the protrusions 12*a* and 12*b* and the axial lengths of the resonator holes 2*a* and 2*b* are equal.

An inner conductor 5is formed on the inner peripheral surface of each of the resonator holes 2*a*, 2*b*, 3*a*, and 3*b*. Except for the end face of the protrusions 12*a* and 12*b*, as the openings of one side of the resonator holes 2*a* and 2*b*, an outer conductor 6 is formed on substantially the entire part of the outer surface of the dielectric block. Input and output electrodes 7*a* and 7*b* separated from the outer conductor 6 are formed at the openings of the external coupling holes 3*a* and 3*b* on the lower surface of the base 11. The input and output electrodes 7*a* and 7*b* are formed extending over the lower and side surfaces of the base. When the dielectric filter is mounted on a circuit board, the side surface on which the input and output electrodes 7*a* and 7*b* are formed is used as a surface for mounting on the board.

The inner conductor 5 of each of the resonator holes 2*a* and 2*b* is separated from the outer conductor 6 at the end face of each of the protrusions 12*a* and 12*b*, respectively, to make the end faces the open faces of the resonator holes 2*a* and 2*b*, and is connected to the outer conductor 6 on the lower surface of the base 11 to make the lower surface the short-circuited surface thereof. The inner conductor 5 of each of the external coupling holes 3*a* and 3*b* is connected to the outer conductor 6 on the upper surface of the base 11 to make the upper surface the short-circuited surface of the external coupling holes 3*a* and 3*b*, and is separated from the outer conductor 6 on the lower surface of the base 11 to make the lower surface the open end thereof.

The dielectric filter comprises a band pass filter constituted of a two-stage resonator corresponding to the resonator holes 2*a* and 2*b*. The two resonators are coupled by a stray capacitance Cs occurring between the inner conductor 5 on each inner peripheral surface of the protrusions 12*a* and 12*b* and the outer conductor 6 on the outer peripheral surface thereof, and a coupling made by the stepped holes. In addition, the inner conductors of the external coupling holes 3*a* and 3*b* make inter-digital couplings with the inner conductors of the adjacent resonator holes 2*a* and 2*b*, respectively, whereby external couplings are obtained.

Next, a description will be given of a method for manufacturing the dielectric filter of the embodiment. The dielectric filter shown in FIG. 1 is integrally molded by a press-molding method and fired so as to obtain the dielectric block 1. On the entire surface of the dielectric block 1, electrode materials such as Cu and Ag are formed by electroless plating so that the inner conductor 5 is formed on the inner peripheral surfaces of the resonator holes 2*a*, 2*b*, 3*a*, and 3*b*, and the outer conductor 6 is formed on the entire part of the outer peripheral surface. The end faces of the protrusions 12*a* and 12*b* of the dielectric block 1 are surface-ground by a rotary grinding machine or sand paper, and the outer conductors 6 of the end faces of the protrusions 12*a* and 12*b* are removed. Then, the outer conductors 6 around the input and output electrodes 7*a* and 7*b* are removed by an ultrasonic finishing machine or the like to separate the input and output electrodes 7*a* and 7*b* from the outer conductor 6. As a result, the dielectric filter shown in FIG. 1 can be produced.

In this embodiment, since the axial lengths of the resonator holes 2*a* and 2*b* are made equal, the outer conductors 6 at the end faces of the protrusions 12*a* and 12*b* can simultaneously be removed, which leads to a significant decrease in the number of procedures for forming the open faces.

Also, the axial lengths of the resonator holes 2*a* and 2*b*, namely, the heights of the protrusions, can be made different to individually grind the end faces of the protrusions. Even in this case, the number of forming procedures is less than that in forming the open face by pattern-printing or removal of a conductor in the case of the conventional art.

Although the above embodiment adopts the dielectric filter constituted of the two-stage resonator in the present invention, it is also possible to adopt a dielectric filter constituted of resonators having three-or-more stages obtained by forming three or more resonator holes in a dielectric block. In this case, an external coupling hole is formed at a position adjacent to an input/output stage resonator hole.

As describe above, in the dielectric filter of the first embodiment, each of the resonator holes of the dielectric block is disposed in the protrusion. Accordingly, the open face of each resonator hole can be easily formed by grinding the end face of the protrusion as an opening face of each resonator hole to make a plane surface, while leaving the outer conductor of the opening face of the external coupling hole.

Since the shape of each open face is a sectional shape of the protrusion, a high dimensional precision can be obtained. In addition, since the faces of the inner conductor of the protrusion and the outer conductor thereof are opposed, a large stray capacitance contributing to a coupling between the resonators can steadily be obtained. In other words, since an open face formed with high precision and stray capacitance having small variations can easily be obtained, variations in filter characteristics due to the variations in forming the open faces are significantly reduced so that a dielectric filter having specified satisfactory characteristics can easily be produced.

Furthermore, stray capacitance can greatly be varied by changing the outer diameter of the protrusion (the thickness of the tube) and the height of the protrusion. In addition, the magnitude of an external coupling can be adjusted by changing the degree of coupling between the external coupling hole and the resonator hole.

Figure 2:
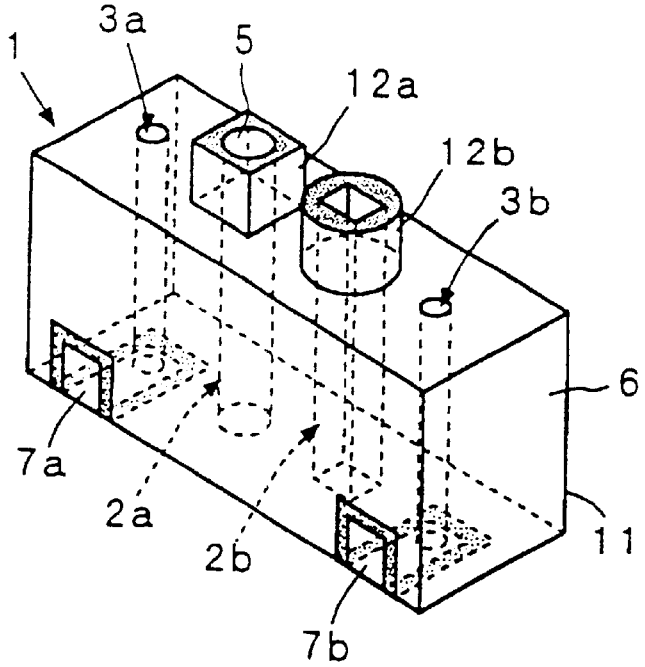
FIG. 2 is a perspective view of a dielectric filter according to a second embodiment of the present invention.

Next, FIG. 2 shows a structure of a dielectric filter in accordance with a second embodiment of the present invention. The dielectric filter shown in FIG. 2 is an example of modifications of the shapes of a protrusion and a resonator hole. In this embodiment, the outer shape of the protrusion 12*a* is formed in a sectional quadrangle, and the resonator hole 2*a* is formed in a sectional circular shape. Additionally, the outer shape of the protrusion 12*b* is of sectional circular form, and the resonator hole 2*b* is formed in a sectional quadrangle. The individual resonator holes 2*a* and 2*b* are straight holes. The other structures and manufacturing procedures shown in FIG. 2 are the same as those illustrated referring to FIG. 1.

In this way, the magnitude of stray capacitance and an external coupling can be adjusted by changing the shapes of the protrusion and the resonator hole, with the result that freedom in adjustment and setting of a coupling between resonators and an external coupling can be enhanced.

Figure 3:
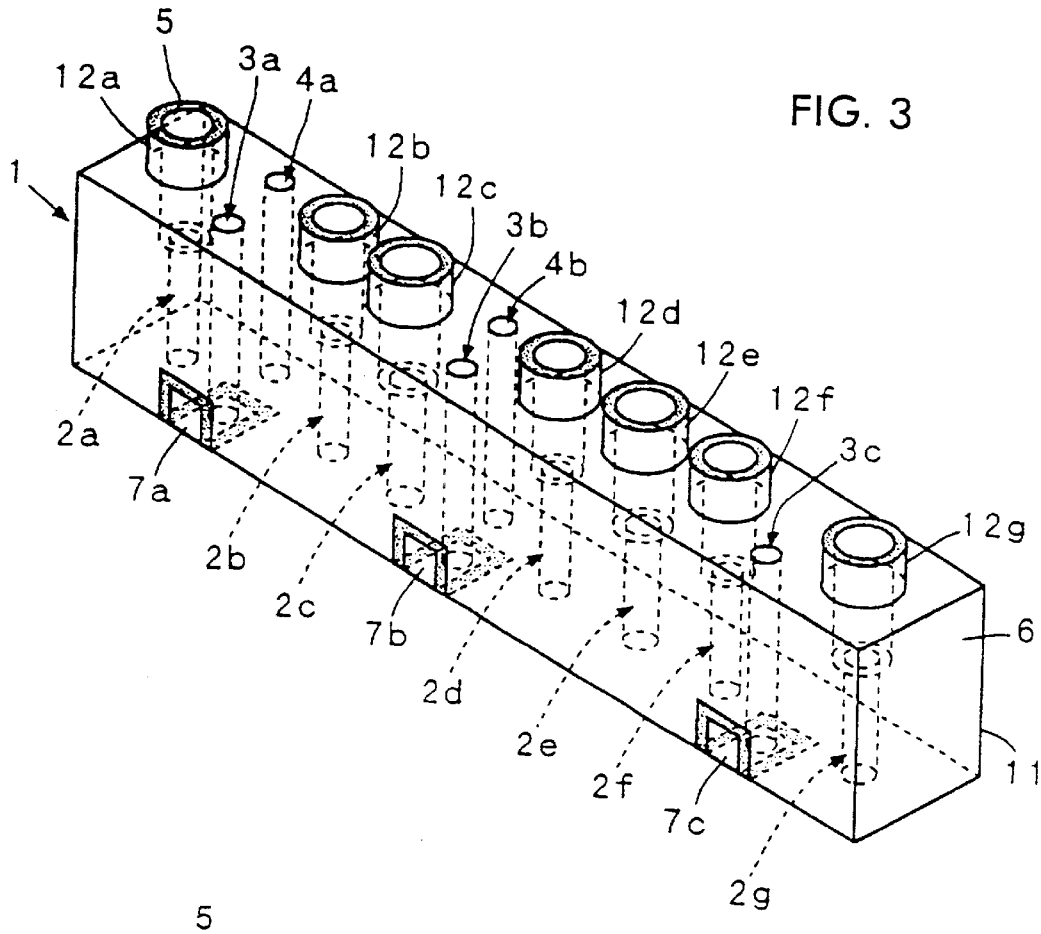
FIG. 3 is a perspective view of a duplexer according to a third embodiment of the present invention.

FIG. 3 shows a structure of a duplexer as an antenna duplexer in accordance with a third embodiment of the present invention. The transmission section of the duplexer includes a band pass filter constituted of a two-stage resonator corresponding to resonator holes 2*b* and 2*c* and a trap resonator corresponding to a resonator hole 2*a*, and the reception section thereof includes a band pass filter constituted of three resonators corresponding to resonator holes 2*d* to 2*f* and a trap resonator corresponding to a resonator hole 2*g*. A plurality of protrusions 12*a* to 12*g* is integrally formed on a base 11 of a dielectric block 1. The resonator holes 2*a* to 2*g* are disposed penetrating from the end faces of the protrusions 12*a* to 12*g* to the lower opposing surface. External coupling holes 3*a*, 3*b*, and 3*c*, external-coupling adjustment holes 4*a* and 4*b* are formed by penetrating the base 11 between the corresponding resonator holes 2*a* and 2*b*, 2*c* and 2*d*, and 2*f* and 2*g*.

An inner conductor 5 is formed on each inner peripheral surface of the resonator holes 2*a* to 2*g*, 3*a* to 3*c*, and 4*a* and 4*b*. An outer conductor 6 is formed on the substantially entire region on the outer surfaces of the dielectric block 1 except for the end faces of the protrusions 12*a* to 12*g*. The open faces of the resonator holes 2*a* to 2*g* of the duplexer are also formed by the manufacturing procedures described in the first embodiment.

Input and output electrodes 7*a*, 7*b*, and 7*c*, separated from the outer conductor 6 and connected to the inner conductors 5 of the external coupling holes 3*a*, 3*b*, and 3*c*, are formed by extending over the lower surface and side surface of the dielectric block 1. The input and output electrode 7*a* serves as the transmission terminal of a transmission filter, the input and output electrode 7*c* serves as the reception terminal of a reception filter. The input and output electrode 7*b* serves as an antenna terminal using the inputs and outputs of both of the transmission filter and the reception filter. The external coupling hole 3*a* makes an inter-digital coupling with the adjacent resonator holes 2*a* and 2*b*, the external coupling hole 3*b* makes an inter-digital coupling with the adjacent resonator holes 2*c* and 2*d*, and the external coupling hole 3*c* makes an inter-digital coupling with the adjacent resonator holes 2*f* and 2*g* so as to obtain external couplings. The inner conductors 5 of the external coupling adjustment holes 4*a* and 4*b* are connected to the outer conductor 6 on the upper surface and lower surface of the base 11, by which not only can an external coupling be adjusted, but a coupling between adjacent resonator holes, between which the external coupling adjustment holes 4*a* and 4*b* are disposed, can also be blocked.

In the third embodiment, as in the first and second embodiments, the sectional shapes of the protrusion and the resonator hole are not limited to being circular. It is possible to use quadrangular or other polygonal sectional shapes.

In addition, in the structure of the third embodiment, the open face of each resonator hole can easily be formed with high precision by grinding the end face of each protrusion so as to obtain the same advantages as those described in the first and second embodiments.

Figure 4:
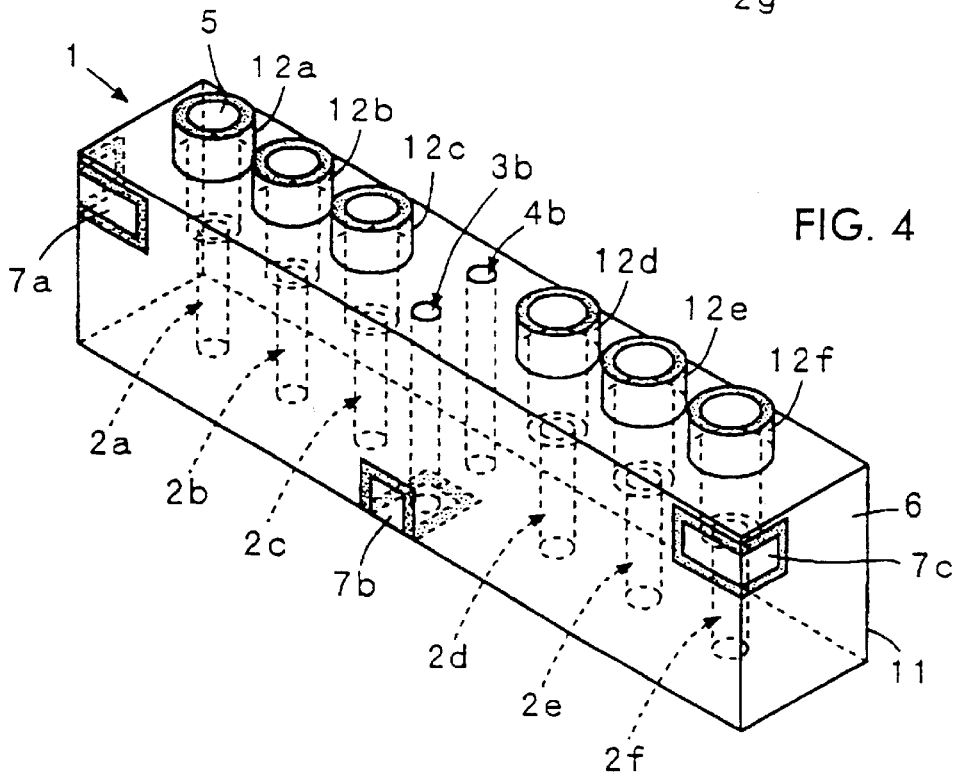
FIG. 4 is a perspective view of a duplexer according to a fourth embodiment of the present invention.

Next, FIG. 4 shows a structure of a duplexer in accordance with a fourth embodiment of the present invention. The transmission section of the duplexer in this embodiment includes a band pass filter constituted of a three-stage resonator corresponding to resonator holes 2*a*, 2*b*, and 2*c*, and the reception section thereof includes a band pass filter constituted of a three-stage resonator corresponding to resonator holes 2*d* to 2*f*. The resonator holes 2*a* to 2*f* are disposed penetrating from the end faces of protrusions 12*a* to 12*f* to the lower surface of a base 11 which opposes the end faces of the protrusions 12*a* to 12*f*. An external coupling hole 3*b* and an external coupling adjustment hole 4*b* are formed between the resonator holes 2*c* and 2*d* by penetrating the base 11.

An inner conductor 5 is formed on each inner peripheral surface of the holes 2*a* to 2*f*, 3*b*, and 4*b*. An outer conductor 6 is formed on the entire outer surface of the dielectric block 1 except for the end faces of the protrusions 12*a* to 12*f*. The open faces of the resonator holes 2*a* to 2*f* of the duplexer are also formed by the procedures described in the first embodiment.

An input and output electrode 7*b* as an antenna terminal is formed by extending over the lower surface and side surface of the dielectric block 1. An input and output electrode 7*a* as a transmission terminal and an input and output electrode 7*c* as a reception terminal are formed by extending over adjacent side surfaces in proximity to the upper surface of the base 11. The input and output electrode 7*a* makes a capacitive coupling with the resonator hole 2*a* and the input and output electrode 7*c* makes a capacitive coupling with the resonator hole 2*f* to obtain an external coupling. The external coupling hole 3*b* makes inter-digital couplings with the adjacent resonator holes 2*c* and 2*d* to obtain external couplings. In this case, it is possible to apply an external coupling means obtained by an external coupling hole in one of the plurality of input and output parts. In addition, formation of the external coupling adjustment hole is not necessarily required.

In the structure of the embodiment, the open face of each resonator hole can easily be formed with high precision by grinding the end face of each protrusion so as to obtain the same advantages as those described in the first and second embodiments.

Figure 5:
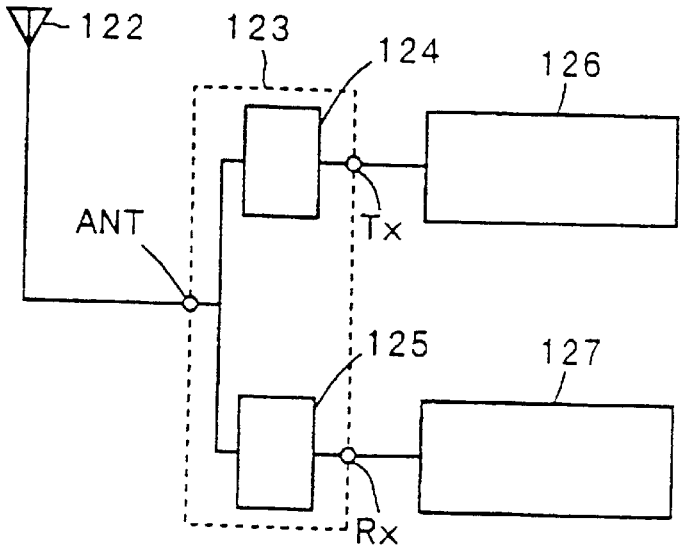
FIG. 5 is a block diagram of a communication apparatus according to a fifth embodiment of the present invention.
Figure 6:
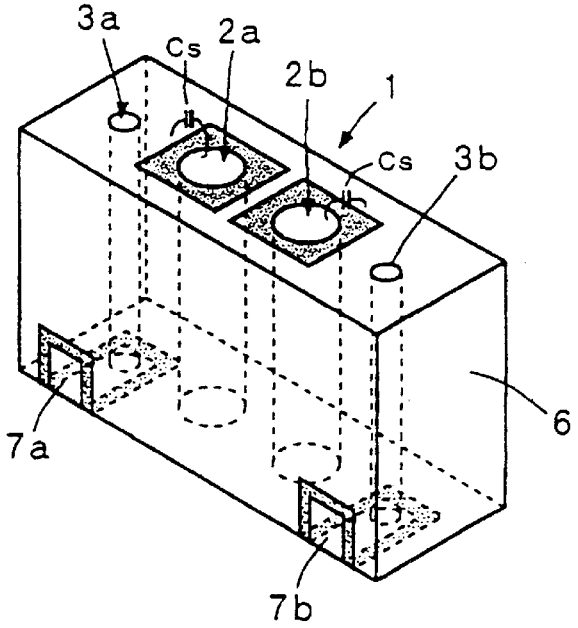
FIG. 6 PRIOR ART
FIG. 6 is a perspective view of a prior art dielectric filter.

Next, FIG. 5 shows a structure of a communication apparatus in accordance with a fifth embodiment of the present invention. In FIG. 5, reference numeral 122 denotes an antenna, reference numeral 123 denotes a duplexer, reference numeral 124 denotes a transmission filter, reference numeral 125 denotes a reception filter, reference numeral 126 denotes a transmission circuit, and reference numeral 127 denotes a reception circuit. An antenna terminal ANT of the duplexer 123 is connected to an antenna 122, a transmission terminal Tx is connected to the transmission circuit 126, and a reception terminal Rx is connected to the reception circuit 127 to form the communication apparatus.

In this case, as the transmission filter 124 or the reception filter 125, the dielectric filter described in one of the first and second embodiments can be applied. In addition, as the duplexer 123, the duplexer described in one of the third and fourth embodiments can be applied. The use of the dielectric filter or duplexer used in the present invention permits a communication apparatus to be produced at lower cost while maintaining satisfactory characteristics.

As described above, in the dielectric filter or duplexer in accordance with the present invention, an external coupling hole is disposed in the base of a dielectric block, and each resonator hole is disposed in a plurality of protrusions formed on the base of the dielectric block. As a result, the open face of the resonator hole can easily be formed with high dimensional precision by grinding the end face of each protrusion to remove an outer conductor formed thereon. In addition, since the faces of the inner conductor and outer conductor of the protrusion formed into a tube configuration oppose, a high stray capacitance contributing to a coupling between the resonators can steadily be obtained. Moreover, the stray capacitance can be varied and the magnitude of an external coupling can be adjusted by changing the configuration of the protrusion.

In addition, when the axial lengths of the resonator holes are equal, all of the end faces of the protrusions, as the open faces of the resonator holes, can be surface-ground together at one time. Therefore, the procedure for forming the open faces can be simplified.

Furthermore, in this invention, since the input and output electrode separated from the outer conductor is formed on an end face opposing the end face where the protrusion is disposed, and the external coupling hole and the adjacent resonator hole make an inter-digital coupling, a larger external coupling can be obtained.

Furthermore, mounting the dielectric filter or duplexer of the present invention permits a communication apparatus with satisfactory characteristics to be produced at low cost.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric filter comprising:

a dielectric block including:

a base having a pair of opposing end faces and side walls extending between the end faces;

a plurality of protrusions formed on one end face thereof;

a resonator hole penetrating from an end face of each protrusion to the other end face of the base;

at least one external coupling hole penetrating between both end faces of the base;

an inner conductor formed on the inner surface of each of the resonator holes and the at least one external coupling hole; and an outer conductor formed on substantially the entire outer surface of the dielectric block except the end face of each protrusion as an open face of each resonator hole;

wherein said protrusions are spaced away from each other and from said side walls of said base.

2. A dielectric filter according to claim 1, wherein the axial lengths of the resonator holes are the same.

3. A dielectric filter according to claim 1, wherein an input and output electrode connected to the inner conductor of the at least one external coupling hole and separated from the outer conductor is formed extending over the other end face of the base of the dielectric block or both the other end face and a side surface thereof.

4. A dielectric filter according to claim 2, wherein an input and output electrode connected to the inner conductor of the at least one external coupling hole and separated from the outer conductor is formed extending over the other end face of the base of the dielectric block or both the other end face and a side surface thereof.

5. A duplexer comprising a dielectric block having at least two or more filters formed therein; wherein at least one of the filters comprises:

a dielectric block including:

a base having a pair of opposing end faces and side walls extending between the end faces;

a plurality of protrusions formed on one end face thereof;

a resonator hole penetrating from an end face of each protrusion to the other end face of the base;

at least one external coupling hole penetrating between both end faces of the base;

an inner conductor formed on the inner surface of each of the resonator holes and the at least one external coupling hole; and an outer conductor formed on substantially the entire outer surface of the dielectric block except the end face of each protrusion as an open face of each resonator hole;

wherein said protrusions are spaced away from each other and from said side walls of said base.

6. A communication apparatus having a dielectric filter, said dielectric filter comprising:

a dielectric block including:

a base having a pair of opposing end faces and side walls extending between the end faces;

a plurality of protrusions formed on one end face thereof;

a resonator hole penetrating from an end face of each protrusion to the other end face of the base;

at least one external coupling hole penetrating between both end faces of the base;

an inner conductor formed on the inner surface of each of the resonator holes and the at least one external coupling hole; and an outer conductor formed on substantially the entire outer surface of the dielectric block except the end of each protrusion as an open face of each resonator hole;

wherein said protrusions are spaced away from each other and from said side walls of said base.

7. A communication apparatus having a duplexer, said duplexer comprising:

a dielectric block having at least two or more filters formed therein;

wherein at least one of the filters comprises:

a dielectric block including:

a base having a pair of opposing end faces and side walls extending between the end faces;

a plurality of protrusions formed on one end face thereof, a resonator hole penetrating from an end face of each protrusion to the other end face of the base;

at least one external coupling hole penetrating between both end faces of the base;

an inner conductor formed on the inner surface of each of the resonator holes and the at least one external coupling hole; and an outer conductor formed on substantially the entire outer surface of the dielectric block except the end face of each protrusion as an open face of each resonator hole;

wherein said protrusions are spaced away from each other and from said side walls of said base.

* * * * *